US011793322B2

(12) United States Patent
Pearce

(10) Patent No.: US 11,793,322 B2
(45) Date of Patent: Oct. 24, 2023

(54) MATTRESSES AND MATTRESS TOPPERS INCLUDING KNITTED FABRIC AND RELATED METHODS

(71) Applicant: Purple Innovation, LLC, Alpine, UT (US)

(72) Inventor: Tony M. Pearce, Alpine, UT (US)

(73) Assignee: Purple Innovation, LLC, Lehi, UT (US)

( * ) Notice: Subject to any disclaimer, the term of this patent is extended or adjusted under 35 U.S.C. 154(b) by 287 days.

(21) Appl. No.: 15/062,621

(22) Filed: Mar. 7, 2016

(65) Prior Publication Data

US 2017/0251825 A1 Sep. 7, 2017

(51) Int. Cl.
*A47C 27/14* (2006.01)
*A47C 31/10* (2006.01)
(Continued)

(52) U.S. Cl.
CPC ..... *A47C 27/14* (2013.01); *A47C 27/002* (2013.01); *A47C 27/085* (2013.01);
(Continued)

(58) Field of Classification Search
CPC ..... A47C 27/14; A47C 27/002; A47C 27/085; A47C 31/001; A47G 9/04; B68G 7/00;
(Continued)

(56) References Cited

U.S. PATENT DOCUMENTS 4,369,284 A 1/1983 Chen
5,488,746 A * 2/1996 Hudson ..... A47C 27/007 5/500
(Continued)

FOREIGN PATENT DOCUMENTS

DE 202012006138 U1 7/2012
DE 202015008053 U1 2/2016
(Continued)

OTHER PUBLICATIONS

Horrocks, A.R. Anand, S.C . . . (2000). Handbook of Technical Textiles—6.13 Stitch Bonding . (pp. 148-149). Woodhead Publishing. Retrieved from https://app.knovel.com/hotlink/pdf/id:kt003BMSQ6/handbook-technical-textiles/stitch-bonding (Year: 2000).*
(Continued)

*Primary Examiner* — Eric J Kurilla
*Assistant Examiner* — Amanda L Bailey
(74) *Attorney, Agent, or Firm* — Dentons Durham Jones Pinegar

(57) ABSTRACT

A mattress or mattress topper includes a cushioning element having an elastomeric material forming intersecting buckling walls that define hollow columns, and a knitted fabric disposed over the cushioning element and configured to move independently of the buckling walls. The elastomeric material includes an elastomeric polymer and a plasticizer. The knitted fabric includes a first layer of stretchable material; a second layer of stretchable material; and a layer of stretchable fill material between the first layer of stretchable material and the second layer of stretchable material. The first layer of stretchable material is knitted together with the second layer of stretchable material as a unitary sheet of fabric including the layer of stretchable fill material. A method of forming a mattress or mattress topper includes disposing a knitted fabric over a cushioning element comprising intersecting buckling walls and configuring the knitted fabric to move independently of the buckling walls.

24 Claims, 4 Drawing Sheets

(51) Int. Cl.

| | |
|---|---|
| ***A47C 27/00*** | (2006.01) |
| ***A47C 31/00*** | (2006.01) |
| ***A47G 9/04*** | (2006.01) |
| ***B68G 7/00*** | (2006.01) |
| ***A47C 27/08*** | (2006.01) |
| ***A47C 27/22*** | (2006.01) |
| ***D04B 1/12*** | (2006.01) |

(52) U.S. Cl.

CPC ..... *A47C 27/086* (2013.01); *A47C 27/22* (2013.01); *A47C 31/001* (2013.01); *A47C 31/105* (2013.01); *A47G 9/04* (2013.01); *B68G 7/00* (2013.01); *D04B 1/123* (2013.01); *D10B 2403/023* (2013.01); *D10B 2403/0241* (2013.01); *D10B 2503/06* (2013.01)

(58) Field of Classification Search

CPC . B32B 5/026; B32B 2479/00; B32B 2601/00; B32B 5/06; B32B 5/073; D04B 1/18; D04B 1/123; D04B 21/12; D04B 21/16; D10B 2403/023; D10B 2403/0241; D10B 2503/06; D10B 2505/08; D10B 2403/022; D10B 2403/0221

See application file for complete search history.

(56) References Cited

U.S. PATENT DOCUMENTS

| | | | | |
|---|---|---|---|---|
| 5,749,111 | A * | 5/1998 | Pearce | A43B 13/04 428/137 |
| 5,994,450 | A | 11/1999 | Pearce | |
| 6,026,527 | A | 2/2000 | Pearce | |
| 6,174,584 | B1 * | 1/2001 | Keller | A47C 27/006 428/102 |
| 6,277,469 | B1 * | 8/2001 | Wildeman | B32B 5/06 428/167 |
| 6,865,759 | B2 | 3/2005 | Pearce | |
| 7,051,389 | B2 * | 5/2006 | Wassilefky | A47G 9/10 5/490 |
| 7,076,822 | B2 | 7/2006 | Pearce | |
| 7,213,421 | B2 * | 5/2007 | Shirasaki | D04B 21/14 66/196 |
| 7,730,566 | B2 | 6/2010 | Flick et al. | |
| 7,823,233 | B2 | 11/2010 | Flick et al. | |
| 7,827,636 | B2 | 11/2010 | Flick et al. | |
| 7,964,664 | B2 | 6/2011 | Pearce | |
| 8,075,981 | B2 | 12/2011 | Pearce et al. | |
| 8,075,987 | B2 | 12/2011 | Pearce et al. | |
| 8,434,748 | B1 | 5/2013 | Pearce et al. | |
| 8,607,387 | B2 | 12/2013 | Flick et al. | |
| 8,628,067 | B2 | 1/2014 | Pearce et al. | |
| 8,784,982 | B2 | 7/2014 | Pearce et al. | |
| 8,919,750 | B2 | 12/2014 | Pearce et al. | |
| 8,932,692 | B2 | 1/2015 | Pearce | |
| 2003/0096899 | A1 | 5/2003 | Pearce | |
| 2007/0283493 | A1 * | 12/2007 | Link | D04H 1/46 5/954 |
| 2011/0010865 | A1 | 1/2011 | Flick et al. | |
| 2011/0314607 | A1 | 12/2011 | Woolfso et al. | |
| 2012/0088085 | A1 | 4/2012 | Kruse | |
| 2012/0102657 | A1 * | 5/2012 | Wildeman | A47C 27/002 5/698 |
| 2012/0255128 | A1 * | 10/2012 | Sytz | A47C 27/008 5/698 |
| 2013/0074273 | A1 | 3/2013 | Blazar | |
| 2015/0104604 | A1 * | 4/2015 | Rock | B32B 27/08 428/86 |
| 2018/0344049 | A1 | 12/2018 | Szpyt | |

FOREIGN PATENT DOCUMENTS

| | | | | |
|---|---|---|---|---|
| EP | 1647619 | A1 * | 4/2006 | D04B 21/14 |
| JP | 2001-514912 | A | 9/2001 | |
| JP | 2009-011665 | A | 1/2009 | |
| WO | 9908571 | A1 | 2/1999 | |
| WO | 2010075293 | A1 | 7/2010 | |

OTHER PUBLICATIONS

"Coupled." American Heritage® Dictionary of the English Language, Fifth Edition. 2011. Houghton Mifflin Harcourt Publishing Company Jul. 31, 2020 https://www.thefreedictionary.com/coupled (Year: 2016).*

Unbounded, (n.d.) American Heritage® Dictionary of the English Language, Fifth Edition. (2011). Retrieved May 18, 2021 from https://www.thefreedictionary.com/unbounded (Year: 2011).*

Unbound, (n.d.) WordNet3.0, Farlex clipart collection. (2003-2008). Retrieved May 19, 2021 from https://www.thefreedictionary.com/unbound (Year: 2003).*

International Search Report for PCT Application No. PCT/US2017/020721 dated May 25, 2017, 5 pages.

Written Opinion of the International Search Report for PCT Application No. PCT/US2017/020721 dated May 25, 2017, 11 pages.

Supplementary European Search Report for European Application Serial No. 17763791.5, dated Jun. 28, 2019.

Australian Patent Office, "Examination Report No. 1" for application No. AU2017228982, dated Jan. 22, 2019.

Chinese National Intellectual Property Adminstration, First Office Action, Chinese Patent Application No. 201780015999.9, dated Apr. 2, 2020.

Canadian Intellectual Property Office, Commissioner's Notice-Application Found Allowable, Canadian Patent Application No. 3,016,700, dated Apr. 1, 2020.

Taiwan Intellectual Property Office, Notice of First Office Action, Taiwan Patent Application No. 106107364, dated May 5, 2020.

Japan Patent Office, "Decision of Final Rejection," Japanese Application No. 2018-545846, dated Aug. 24, 2020.

Chinese National Intellectual Property Administration, "Decision of Rejection," Chinese Application No. 201780015999.9, dated Jul. 2, 2021.

Japan Patent Office, "First Office Action," Japanese Application No. 2020-214505, dated Mar. 10, 2022.

Korean Intellectual Property Office, "Grounds for Rejection," Korean application No. 10-2018-7028892, dated Sep. 11, 2019.

Canadian Intellectual Property Office, "Examiner's Report," Canadian application No. 3,016,700, dated Jun. 5, 2019.

IP Australia, "Examination Report No. 2," Australian application No. 2017228982, dated Dec. 19, 2019.

Korean Intellectual Property Office, "Notice of Allowance," Korean application No. 10-2018-7028892, dated Mar. 18, 2020.

European Patent Office "Communication pursuant to Article 94(3)EPC" European Application No. 17763791.5, dated Jul. 20, 2022.

Japan Patent Office, "Reason for Rejection," Japanese application No. JP2018-545846, dated Nov. 25, 2019.

European Patent Office, "Communication pursuant to Article 94(3) EPC," European Application No. 17763791.5, dated Nov. 19, 2020.

Chinese National Intellectual Property Administration, "Second Office Action," Chinese Application No. 201780015999.9, dated Dec. 30, 2020.

IP Australia, "Examination Report No. 1," Australian Application No. 2020200278, dated Feb. 5, 2021.

Japan Patent Office, "Decision of Rejection," Japanese Application No. 2020-214505, dated Jan. 11, 2023.

* cited by examiner

MATTRESSES AND MATTRESS TOPPERS INCLUDING KNITTED FABRIC AND RELATED METHODS

FIELD

Embodiments of the disclosure relate generally to cushioning elements such as mattresses and mattress toppers, fabrics for use with cushioning elements, products including cushioning elements, and to methods of making and using fabrics and cushioning elements.

BACKGROUND

Cushioning materials have a variety of uses, such as for mattresses, seating surfaces, shoe inserts, packaging, medical devices, etc. Cushioning materials may be formulated and/or configured to reduce peak pressure on a cushioned body, which may increase comfort for humans or animals, and may protect objects from damage. Cushioning materials may be formed of materials that deflect or deform under load, such as polyethylene or polyurethane foams (e.g., convoluted foam), vinyl, rubber, springs, natural or synthetic fibers, fluid-filled flexible containers, etc. Different cushioning materials may have different responses to a given pressure, and some materials may be well suited to different applications. Cushioning materials may be used in combination with one another to achieve selected properties.

U.S. Pat. No. 7,730,566, "Multi-Walled Gelastic Material," issued Jun. 8, 2010, the disclosure of which is incorporated herein in its entirety by this reference, describes cushion structures having interconnected walls that buckle. A first wall buckles when a threshold force is applied. Buckling of the first wall may cause buckling of a second wall, which may decrease the chance that the first wall will "bottom out." Bottoming out would increase pressure on the portion of the cushioned object over the buckled portion of the cushion. One side of the cushion has walls spaced relatively close together, and the opposite side has walls spaced farther apart. That is, some walls of the cushion extend only partially through the cushion. The wider-spaced portions of the walls may buckle more easily than the closer-spaced portions of the walls when an irregularly shaped object presses against the walls.

U.S. Pat. No. 8,919,750, "Cushioning Elements Comprising Buckling Walls and Methods of Forming Such Cushioning Elements," issued Dec. 30, 2014, the disclosure of which is incorporated herein in its entirety by this reference, describes a cushioning element having a top cushioning surface and a bottom base surface, which includes an elastomeric material and a stabilizing material. Interconnected buckling walls formed of the elastomeric material are connected to the stabilizing material.

When lying on a core that has a top surface (or a surface near the top, underneath a cover) of buckling walls formed of an elastomeric material, there may be a degree of discomfort or undesirable awareness associated with the buckling members of the elastomeric material. For example, if the buckling elastomer has square hollow columns (for example, as shown in U.S. Pat. No. 8,919,750, discussed above, or in U.S. Pat. No. 6,026,527, "Gelatinous Cushions with Buckling Columns," issued Feb. 22, 2000, the disclosure of which is incorporated herein in its entirety by this reference), the user of the mattress or mattress topper may feel the squares on his or her skin, or may undesirably feel the buckling action. Generally, a top foam may be placed above the buckling elastomer, or a top-quilted set of fabrics and/or foams may be placed atop the buckling elastomer. This may completely or at least partially overcome the undesirable sensations. However, it may be expensive to put foam atop the buckling elastomer, which may involve multiple steps of cutting the foam, heat fusing a bondable fabric into the buckling elastomer, gluing the bondable fabric to the foam, etc. A top quilt may also be undesirable because of the cost of the various layers of quilted material (for example a typical quilt package may be a knitted top fabric, a foam, poly-fluff fiber, and a bottom piece of non-stretchable fabric, which may be generally necessary to pull the quilt through the quilting machine) and the cost and complexity of the quilting machine and process.

BRIEF SUMMARY

In some embodiments, a mattress or mattress topper includes a cushioning element comprising an elastomeric material forming a plurality of intersecting buckling walls defining a plurality of hollow columns, wherein the elastomeric material comprises an elastomeric polymer and a plasticizer; and a knitted fabric disposed over the cushioning element and configured to move independently of the buckling walls of the cushioning element. The knitted fabric includes a first layer of stretchable material; a second layer of stretchable material; and a layer of stretchable fill material between the first layer of stretchable material and the second layer of stretchable material. The first layer of stretchable material is knitted together with the second layer of stretchable material as a unitary sheet of fabric including the layer of stretchable fill material.

A method of forming a mattress or mattress topper includes disposing a knitted fabric over a cushioning element that includes intersecting buckling walls and configuring the knitted fabric to move independently of the buckling walls of the cushioning element. The knitted fabric comprises a first layer of stretchable material, a second layer of stretchable material, and a layer of stretchable fill material between the first layer of stretchable material and the second layer of stretchable material. The first layer of stretchable material is knitted together with the second layer of stretchable material as a unitary sheet of fabric including the layer of stretchable fill material. The cushioning element includes an elastomeric material forming the intersecting buckling walls, and the buckling walls define a plurality of hollow columns. The elastomeric material includes an elastomeric polymer and a plasticizer.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

Figure 1:
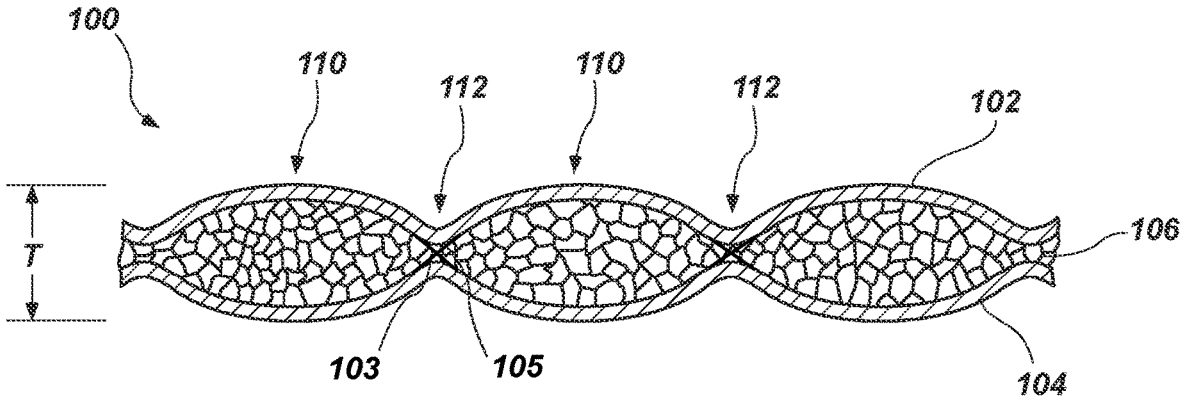
FIG. 1 is a simplified cross-sectional side view illustrating an embodiment of a knitted fabric according to the present disclosure.

As used herein, the term "cushioning element" means and includes any deformable device intended for use in cushioning one body (e.g., a person, animal, or object) relative to another. As a non-limiting example, cushioning elements (e.g., mattresses, mattress toppers, seat cushions, etc.) include materials intended for use in cushioning a person, animal, or object relative to another object (e.g., a chair seat) that might otherwise abut against the person, animal or object.

As used herein, the term "elastomeric polymer" means and includes a polymer capable of recovering its original size and shape after deformation. In other words, an elastomeric polymer is a polymer having elastic or viscoelastic properties. Elastomeric polymers may also be referred to as "elastomers" in the art. Elastomeric polymers include, without limitation, homopolymers (polymers having a single chemical unit repeated) and copolymers (polymers having two or more chemical units).

As used herein, the term "elastomeric block copolymer" means and includes an elastomeric polymer having groups or blocks of homopolymers linked together, such as A-B diblock copolymers and A-B-A triblock copolymers. A-B diblock copolymers have two distinct blocks of homopolymers. A-B-A triblock copolymers have two blocks of a single homopolymer (A) each linked to a single block of a different homopolymer (B).

As used herein, the term "plasticizer" means and includes a substance added to another material (e.g., an elastomeric polymer) to increase a workability of the material. For example, a plasticizer may increase the flexibility, softness, or extensibility of the material. Plasticizers include, without limitation, hydrocarbon fluids, such as mineral oils. Hydrocarbon plasticizers may be aromatic or aliphatic.

As used herein, the term "elastomeric material" means and includes elastomeric polymers and mixtures of elastomeric polymers with plasticizers and/or other materials. Elastomeric materials are elastic (i.e., capable of recovering size and shape after deformation). Elastomeric materials include, without limitation, materials referred to in the art as "elastomer gels," "gelatinous elastomers," or simply "gels."

As used herein, the terms "stretchable" and "stretchable material" mean and include a fabric having the ability to stretch to at least 120% of its undeformed length when pulled (i.e., may increase its length by at least 20%), yet return to its original shape when released. "Two-way" stretchable material stretches in two opposite directions, whereas "four-way" stretchable material stretches in two mutually opposing directions plus two directions perpendicular to the two mutually opposing directions (i.e., in two directions perpendicular to one another and in each direction opposite each of these perpendicular directions).

As used herein, the terms "knitted" and "knit" mean and include a fabric formed by interlocking loops of threads or yarns. Knitted fabrics are porous and stretchable even when formed of non-stretchable fibers, because the threads can shift within a matrix of loops.

The illustrations presented herein are not actual views of any particular material or device, but are merely idealized representations employed to describe embodiments of the present disclosure. Elements common between figures may retain the same numerical designation.

The present disclosure describes knitted fabric including multiple layers of stretchable material knitted together as a unitary sheet. The fabric can be of a relatively heavy gage having suitable bulk for providing some cushioning effect when used in conjunction with a mattress, mattress topper, or other cushioning device having buckling walls. The fabric may alleviate problems associated with placing foam layers or quilted layers over buckling walls. In particular, foam and quilted layers may each have relatively low stretchiness due to, for example, adhesives, stitching, or non-stretch fabric. This lack of sufficient stretchiness may inhibit the desirable buckling action, particularly local buckling around a protrusion such as a human hip, and thus a mattress or mattress topper of such materials may be less comfortable, have higher peak pressures on the user, and may have less ability to align the user's spine. A knitted fabric as disclosed herein may provide cushioning and be stretchable, such that buckling walls are less noticeable to a user.

FIG. 1 is a simplified cross-sectional view of a knitted fabric 100, which may include a top layer 102, a bottom layer 104, and a fill material 106. Though shown and described as "top" and "bottom" for simplicity and clarity, the top layer 102 and bottom layer 104 may be formed and used in any orientation, including inverted from the direction shown, rotated 90°, etc. Each of the top layer 102, bottom layer 104, and fill material 106 may be formed of a stretchable material, such that the overall fabric 100 remains stretchable. The top layer 102, bottom layer 104, and fill material 106 may be knitted together as a single unitary sheet of fabric, such that no adhesive, stitching, or other attachment may be necessary to connect the top layer 102, bottom layer 104, and fill material 106 after knitting the fabric 100. The fabric 100 may be substantially free of non-stretchable material.

To form the knitted fabric 100, threads may be knitted to form the top layer 102 and bottom layer 104 simultaneously, encapsulating the fill material 106 as the top layer 102 and bottom layer 104 are formed. For example, a fiber or thread 103 may be used to form a portion of the top layer 102, then looped to form a portion of the bottom layer 104 (though the knitted fabric 100 may include more than one of such fibers or threads 103). Likewise, a fiber or thread 105 may be used to form a portion of the bottom layer 104, then looped to form a portion of the top layer 102 (though the knitted fabric 100 may include more that one of such fibers or threads 105). The fill material 106 may be formed of threads selected for bulk or fluff. When the top layer 102 is looped with the bottom layer 104, the fill material 106 may be encapsulated into the knitted fabric 100. In some embodiments, a machine, such as a circular knitting machine, may form a portion of the top layer 102 (e.g., one or a few loops), then form a portion of the bottom layer 104. The process may be repeated to form the entire knitted fabric 100 as a unitary sheet.

The fabric 100 may exhibit stretchiness in at least two directions perpendicular to one another, which in the industry may be referred to as "four-way stretch." For example, the fabric 100 may stretch in each of two perpendicular directions in the plane of a surface of the fabric 100, such that a force acting on the fabric 100 in any direction in the plane of the surface may cause the fabric 100 to stretch in that direction. To achieve such a property, the fabric 100 may consist essentially or entirely of materials exhibiting stretchiness in at least two directions perpendicular to one another (e.g., in directions parallel to a surface of the fabric 100). The fabric 100 may also stretch in a third perpendicular direction (e.g., perpendicular to a surface of the fabric 100).

The stretchable material of the fabric 100 may include, for example, an elastomeric fiber. Elastomeric fibers, which may also be known in the art as "soft fibers," may stretch as much as 400% or more while retaining the ability to return to their original shape. Elastomeric fibers include, for example, spandex (i.e., "a manufactured fiber in which the fiber-forming substance is a long chain synthetic polymer comprised of at least 85% of a segmented polyurethane" (see 16 C.F.R. § 303.7)), natural or synthetic rubber, olefins, polyesters, polyethers, etc., and combinations thereof. In some embodiments, the fabric 100 may include at least about 1% elastomeric fiber by weight, such as from about 3% to about 20% elastomeric fiber by weight, or from about 8% to about 15% elastomeric fiber by weight.

In some embodiments, the fabric 100 may have a weight per unit area of at least about 250 $g/m^2$, at least about 400 $g/m^2$, or even at least about 650 $g/m^2$. The fabric 100 may have a bulk or maximum uncompressed thickness T of at least about 2.5 mm, at least about 5.0 mm, or at least about 25 mm. The weight and thickness of the fabric 100 may provide the fabric 100 with the ability to provide some cushioning effect.

The fabric 100 may have a varying thickness when uncompressed. For example, as shown in FIG. 1, the fabric 100 may have relatively thicker sections 110 and relatively thinner sections 112. The top layer 102 and the bottom layer 104 may be knitted together by interlocking loops of thread in the thinner sections 112 of the fabric 100. The fabric 100 may be knitted such that the fill material 106 is thicker in the thicker sections 110 than in the thinner sections 112, whereas the top layer 102 and bottom layer 104 may each be an approximately uniform thickness. The fabric 100 may be knitted to maintain the shape of the thicker sections 110 and thinner sections 112 to retain the fill material 106 in position. The fabric 100 may be shaped such that it has the appearance of a quilted fabric, yet may be a single, unitary sheet. Thus, manufacturing of the fabric 100 may be simpler and less expensive than quilting.

Figure 2:
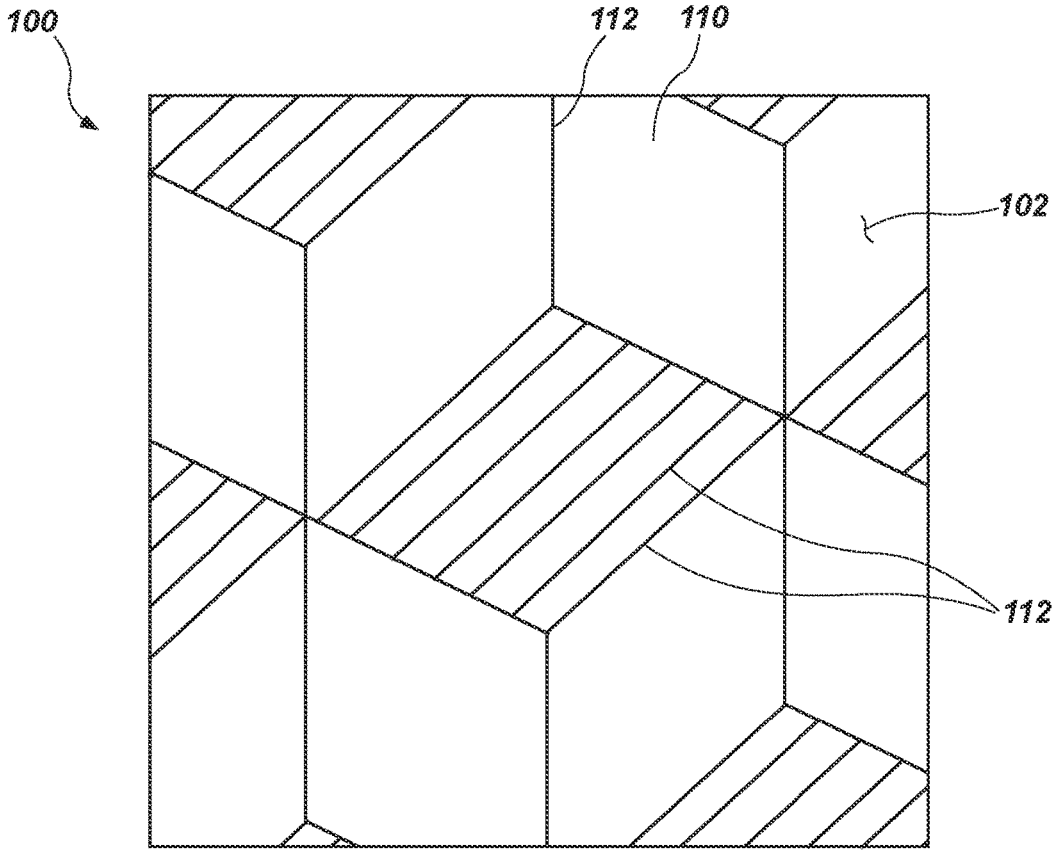
FIG. 2 is a simplified top view of the knitted fabric shown in FIG. 1.

FIG. 2 illustrates how the fabric 100 may appear from above or below. The thinner sections 112 may generally form lines or curves in the surface of the fabric 100, which may have the appearance of quilting stitches. The thinner sections 112 may be in any selected pattern for aesthetic or other purposes.

The fabric 100 may be configured to compress under a load, such that the fabric 100 may provide a cushioning effect. The fabric 100 may be used over a mattress or other cushion to improve cushioning properties of the mattress or cushion.

Figure 3:
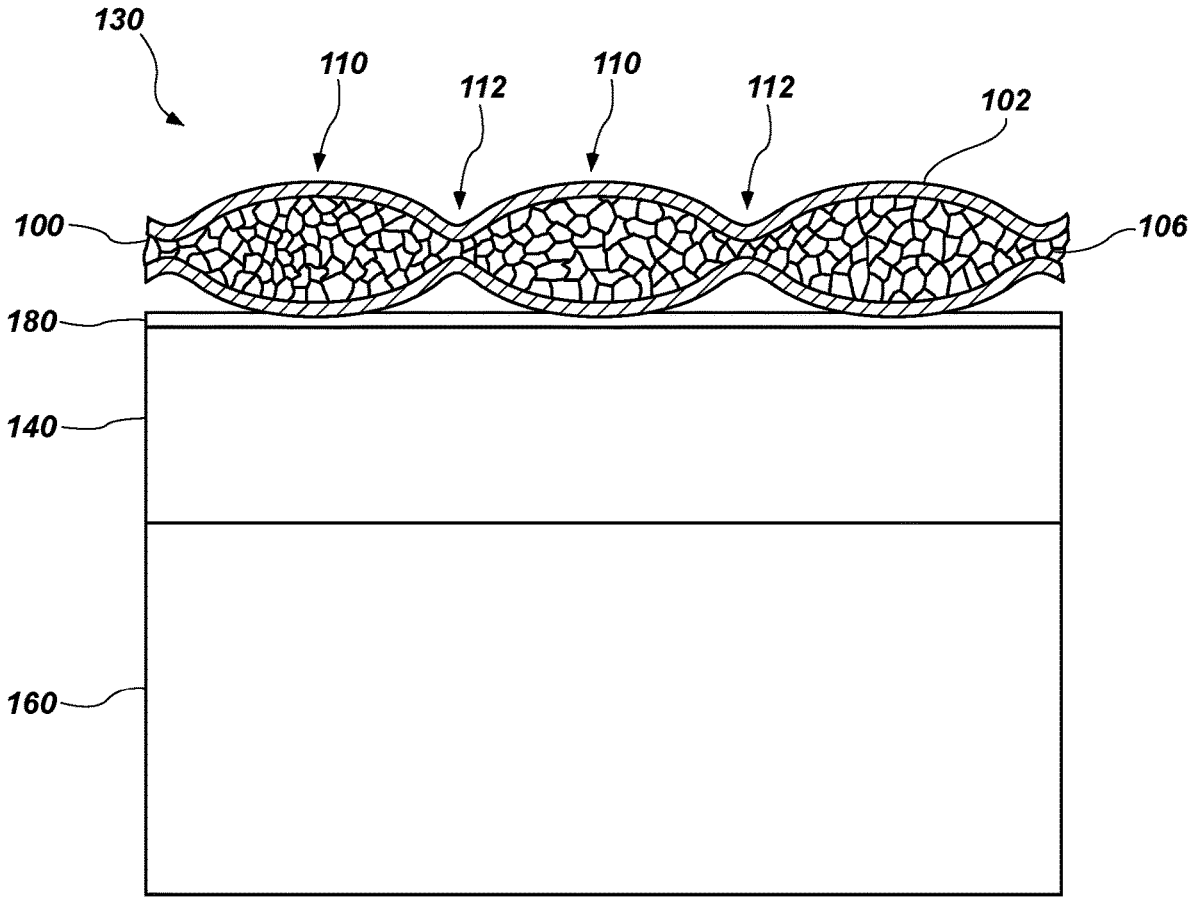
FIG. 3 is a simplified cross-sectional view illustrating a portion of a mattress or mattress topper including the fabric of FIG. 1 coupled with other cushioning elements.

FIG. 3 is a simplified cross-sectional view illustrating a portion of a mattress or mattress topper 130 (hereinafter, "mattress 130") including the fabric 100 and other cushioning elements. In particular, the fabric 100 is depicted resting over an elastomeric cushioning element 140, which is over a foam base 160. The fabric 100 may be configured to move independently of the elastomeric cushioning element 140 and the foam base 160, and thus may not be bonded to the elastomeric cushioning element 140 along the interface between the fabric 100 and the elastomeric cushioning element 140. Instead, the fabric 100 may be incorporated into a removable cover for the elastomeric cushioning element 140 and optionally the foam base 160, and may be connected to the elastomeric cushioning element 140 at the edges of the elastomeric cushioning element 140, such as by at least partially surrounding the elastomeric cushioning element 140. Thus, the fabric 100 may freely move laterally with respect to the underlying elastomeric cushioning element 140, at least along the interface therebetween. The fabric 100 may be removed for washing or replacement.

In some embodiments, another stretchable material 180 may be disposed between the fabric 100 and the elastomeric cushioning element 140, such as a knitted flame-retardant fabric. The stretchable material 180 may be secured to or integral with either the fabric 100 or the elastomeric cushioning element 140, but typically not to both, so as to allow the fabric 100 and the elastomeric cushioning element 140 to move freely relative to one another. In some embodiments, the stretchable material 180, if present, may be distinct from both the fabric 100 and the elastomeric cushioning element 140. The stretchable material 180 may be relatively thinner than the fabric 100, such that the stretchable material 180 provides little or no cushioning effect to the mattress 130. For example, the stretchable material 180 may have a thickness of less than about 1.5 mm, less than about 1.0 mm, or less than about 0.5 mm. In other embodiments, the fabric 100 may be in direct physical contact with the elastomeric cushioning element 140, without any other material between the fabric 100 and the elastomeric cushioning element 140.

The fabric 100 may have a bulk thickness T larger than conventional stretchable mattress covers. Conventional mattress covers are typically designed to protect a mattress from soiling and wear without constraining the mattress, but are not typically meant to provide cushioning themselves. Thus, conventional mattress covers are typically relatively thin, such as from about 0.5 mm to about 2 mm thick. Such thinner covers are typically selected because they weigh less and are less expensive to produce than thicker covers. However, it has unexpectedly been found that the fabric 100, having a knit construction of flexible material with a thickness on the order at least about 2.5 mm, can provide a cushioning effect. When placed over, but not affixed to, an elastomeric cushioning element 140, such a fabric 100 may alleviate pressure of individual cushioning features within the elastomeric cushioning element 140. Furthermore, the fabric 100, being formed as a single unitary sheet, may be less expensive to produce than multi-layered quilted fabrics, and may be formed without the use of a non-stretchable material layer typically required for quilting.

The elastomeric cushioning element 140 may include, for example, an elastomeric cushioning material as described in U.S. Pat. No. 7,076,822, "Stacked Cushions," issued Jul. 18, 2006; U.S. Pat. No. 7,730,566, "Multi-Walled Gelastic Material," issued Jun. 8, 2010; U.S. Pat. No. 8,075,981, "Alternating Pattern Gel Cushioning Elements and Related Methods," issued Dec. 13, 2011; U.S. Pat. No. 8,434,748, "Cushions Comprising Gel Springs," issued May 7, 2013; U.S. Pat. No. 8,628,067, "Cushions Comprising Core Structures and Related Methods," issued Jan. 14, 2014; and U.S. Pat. No. 8,919,750, "Cushioning Elements Comprising Buckling Walls and Methods of Forming Such Cushioning Elements," issued Dec. 30, 2014; the entire disclosures of which are hereby incorporated herein by this reference.

Figure 4:
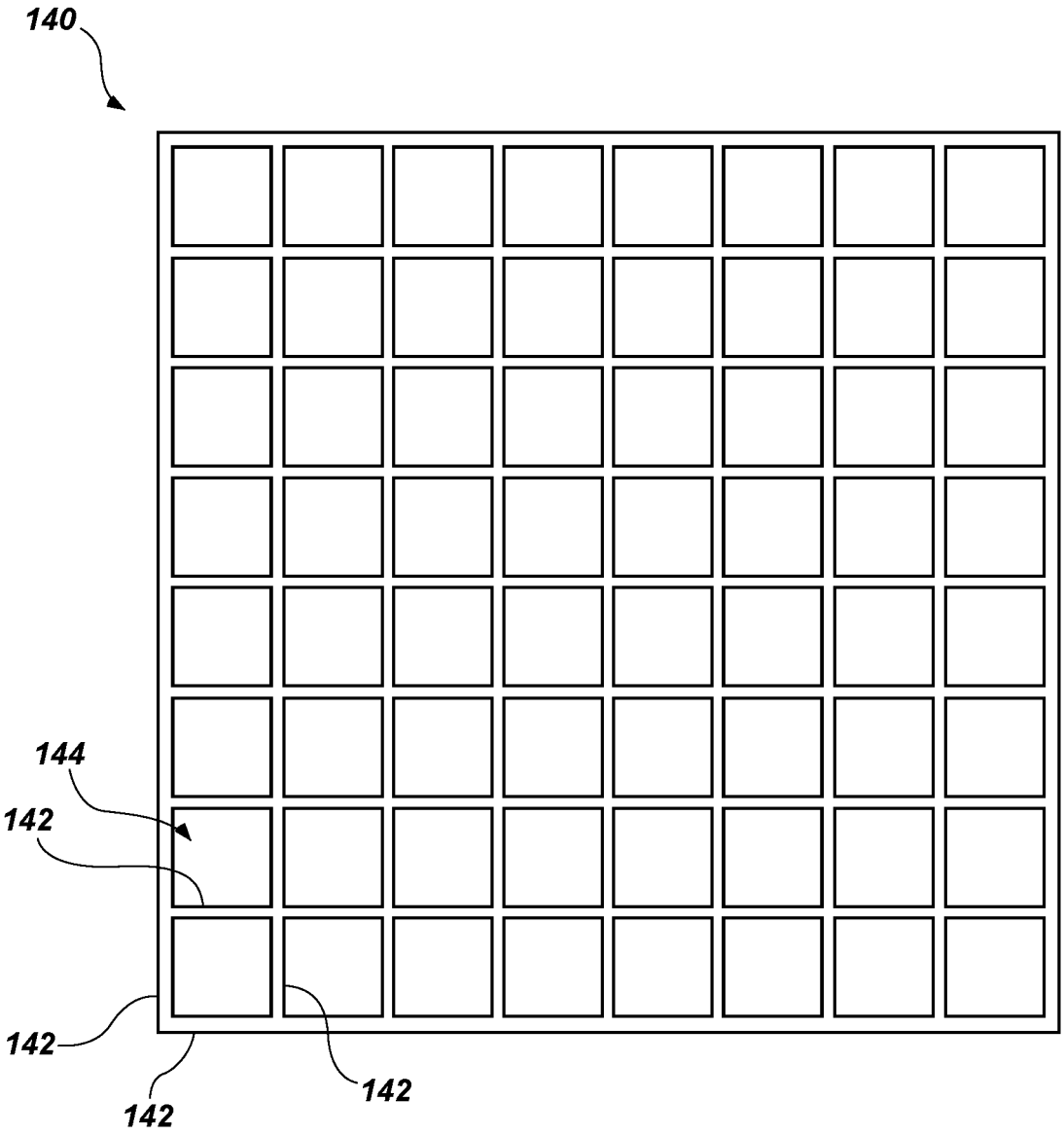
FIG. 4 is a simplified top view of an elastomeric cushioning element that may be part of the mattress or mattress topper shown in FIG. 3.

FIG. 4 is a simplified top view of the elastomeric cushioning element 140. The elastomeric cushioning element 140 includes intersecting buckling walls 142 that are interconnected and define hollow columns 144 or voids. Though the buckling walls 142 are depicted as intersecting at right angles, the buckling walls 142 may be in any selected configuration. For example, the buckling walls 142 may be configured to form triangular hollow columns 144, hexagonal hollow columns 144, skewed parallelogram hollow columns 144, etc.

The elastomeric cushioning element 140 may have any selected dimensions based on the intended use. For example, if the mattress 130 is a mattress for a queen size bed, the elastomeric cushioning element 140 may be approximately 60 inches (152 cm) by 80 inches (203 cm), with a thickness of about 2 inches (5.08 cm). In some embodiments, the thickness of the elastomeric cushioning element 140 may be between about 1 inch (2.54 cm) and about 10 inches (25.4 cm), such as from about 2 inches (5.08 cm) to about 6 inches (15.24 cm). The thickness of the elastomeric cushioning element 140 may vary based on the thickness of other parts of the mattress 130.

In some embodiments, the elastomeric cushioning element 140 may be configured to be used instead of a support core of springs or firm foam in a conventional mattress. To provide a mattress that may be easily lifted and maneuvered, the elastomeric cushioning element 140 may be configured to have a lower overall density than the fabric 100. As used herein, the term "overall density" means and includes the mass of the elastomeric cushioning element 140 divided by the volume of the elastomeric cushioning element 140 as determined by its outside dimensions, including the volume of the interiors of the columns 144 in the elastomeric cushioning element 140.

To keep the overall density of the elastomeric cushioning element 140 low, the volume of the interiors of the columns 144 may be increased, and the volume of the buckling walls 142 may be decreased. For example, the buckling walls 142 may be relatively thin in comparison with conventional cushioning elements. Similarly, the spaces between adjacent buckling walls 142 may be relatively wide in comparison with conventional cushioning elements. For example, the spaces between adjacent buckling walls 142 may be at least about 0.5 inch (1.27 cm), at least about 1.0 inch (2.54 cm), or even larger. In some embodiments, a ratio of the distance between adjacent buckling walls 142 to the thickness of the buckling walls 142 may be from about 10 to about 100, such as from about 20 to about 60, or from about 30 to about 50. For example, an elastomeric cushioning element 140 may have buckling walls 142 with a thickness of about 0.05 inch (1.3 mm) and a distance between adjacent buckling walls 142 of about 1.0 inch (2.54 cm). In some embodiments, the elastomeric cushioning element 140 may have an overall density from about 3.6 $lb/ft^3$ (57.7 $kg/m^3$) to about 12 $lb/ft^3$ (192.2 $kg/m^3$), such as from about 4.8 $lb/ft^3$ (76.9 $kg/m^3$) to about 9.9 $lb/ft^3$ (158.6 $kg/m^3$), or from about 6.0 $lb/ft^3$ (96.1 $kg/m^3$) to about 7.2 $lb/ft^3$ (115.3 $kg/m^3$). The elastomeric material forming the buckling walls 142 may have a density of less than about 56 $lb/ft^3$ (900 $kg/m^3$), less than about 53 $lb/ft^3$ (850 $kg/m^3$), or even less than about 50 $lb/ft^3$ (800 $kg/m^3$).

The buckling walls 142 are formed of and comprise an elastomeric material. Elastomeric materials are described in, for example, U.S. Pat. No. 5,994,450, "Gelatinous Elastomer and Methods of Making and Using the Same and Articles Made Therefrom," issued Nov. 30, 1999; U.S. Pat. No. 7,964,664, "Gel with Wide Distribution of MW in Mid-Block," issued Jun. 21, 2011; and U.S. Pat. No. 4,369,284, "Thermoplastic Elastomer Gelatinous Compositions," issued Jan. 18, 1983; the disclosures of each of which are incorporated herein in their entirety by this reference. The elastomeric material may include an elastomeric polymer and a plasticizer. The elastomeric material may be a gelatinous elastomer (also referred to in the art as gel, elastomer gel, or elastomeric gel), a thermoplastic elastomer, a natural rubber, a synthetic elastomer, a blend of natural and synthetic elastomers, etc.

The elastomeric polymer may be an A-B-A triblock copolymer such as styrene ethylene propylene styrene (SEPS), styrene ethylene butylene styrene (SEBS), and styrene ethylene ethylene propylene styrene (SEEPS). For example, A-B-A triblock copolymers are currently commercially available from Kuraray America, Inc., of Houston, Tex., under the trade name SEPTON® 4055, and from Kraton Polymers, LLC, of Houston, Tex., under the trade names KRATON® E1830, KRATON® G1650, and KRATON® G1651. In these examples, the "A" blocks are styrene. The "B" block may be rubber (e.g., butadiene, isoprene, etc.) or hydrogenated rubber (e.g., ethylene/propylene or ethylene/butylene or ethylene/ethylene/propylene) capable of being plasticized with mineral oil or other hydrocarbon fluids. The elastomeric material may include elastomeric polymers other than styrene-based copolymers, such as non-styrenic elastomeric polymers that are thermoplastic in nature or that can be solvated by plasticizers or that are multi-component thermoset or cross-linked elastomers.

The elastomeric material may include one or more plasticizers, such as hydrocarbon fluids. For example, elastomeric materials may include aromatic-free food-grade white paraffinic mineral oils, such as those sold by Sonneborn, Inc., of Mahwah, N.J., under the trade names BLANDOL® and CARNATION®.

In some embodiments, the elastomeric material may have a plasticizer-to-polymer ratio from about 0.1:1 to about 50:1 by weight. For example, elastomeric materials may have plasticizer-to-polymer ratios from about 1:1 to about 30:1 by weight, or even from about 1.5:1 to about 10:1 by weight. In further embodiments, elastomeric materials may have plasticizer-to-polymer ratios of about 4:1 by weight.

The elastomeric material may have one or more fillers (e.g., lightweight microspheres). Fillers may affect thermal properties, density, processing, etc., of the elastomeric material. For example, hollow microspheres (e.g., hollow glass microspheres or hollow acrylic microspheres) may decrease the thermal conductivity of the elastomeric material by acting as an insulator because such hollow microspheres (e.g., hollow glass microspheres or hollow acrylic microspheres) may have lower thermal conductivity than the plasticizer or the polymer. As another example, metal particles (e.g., aluminum, copper, etc.) may increase the thermal conductivity of the resulting elastomeric material because such particles may have greater thermal conductivity than the plasticizer or polymer. Microspheres filled with wax or another phase-change material (i.e., a material formulated to undergo a phase change near a temperature at which a cushioning element may be used) may provide temperature stability at or near the phase-change temperature of the wax or other phase-change material within the microspheres (i.e., due to the heat of fusion of the phase change). The phase-change material may have a melting point from about 20° C. to about 45° C.

The elastomeric material may also include antioxidants. Antioxidants may reduce the effects of thermal degradation during processing or may improve long-term stability. Antioxidants include, for example, pentaerythritol tetrakis(3-(3,5-di-tert-butyl-4-hydroxyphenyl) propionate), commercially available as IRGANOX® 1010, from BASF Corp., of Iselin, N.J. or as EVERNOX®-10, from Everspring Corp., USA, of Los Angeles, Calif. octadecyl-3-(3,5-di-tert-butyl-4-hydroxyphenyl)propionate, commercially available as IRGANOX® 1076, from BASF Corp. or as EVERNOX®

76, from Everspring Chemical; and tris(2,4-di-tert-butylphenyl)phosphite, commercially available as IRGAFOS® 168, from BASF Corp. or as EVERFOS® 168, from Everspring Corp., USA. One or more antioxidants may be combined in a single formulation of elastomeric material. The use of antioxidants in mixtures of plasticizers and polymers is described in columns 25 and 26 of U.S. Pat. No. 5,994,450, previously incorporated by reference. The elastomeric material may include up to about 5 wt % antioxidants. For instance, the elastomeric material may include from about 0.10 wt % to about 1.0 wt % antioxidants.

In some embodiments, the elastomeric material may include a resin. The resin may be selected to modify the elastomeric material to slow a rebound of the elastomeric cushioning element 140 after deformation. The resin, if present, may include a hydrogenated pure monomer hydrocarbon resin, such as those commercially available from Eastman Chemical Company, of Kingsport, Tenn., under the trade name REGALREZ®. The resin, if present, may function as a tackifier, increasing the stickiness of a surface of the elastomeric material.

In some embodiments, the elastomeric material may include a pigment or a combination of pigments. Pigments may be aesthetic and/or functional. That is, pigments may provide an elastomeric cushioning element 140 with an appearance appealing to consumers. In addition, an elastomeric cushioning element 140 having a dark color may absorb radiation differently than an elastomeric cushioning element 140 having a light color.

The elastomeric material may include any type of gelatinous elastomer. For example, the elastomeric material may include a melt-blend of one part by weight of a styrene-ethylene-ethylene-propylene-styrene (SEEPS) elastomeric triblock copolymer (e.g., SEPTON® 4055) with four parts by weight of a 70-weight straight-cut white paraffinic mineral oil (e.g., CARNATION® white mineral oil) and, optionally, pigments, antioxidants, and/or other additives.

The elastomeric material may include a material that returns to its original shape after deformation, and that may be elastically stretched. The elastomeric material may be rubbery in feel, but may deform to the shape of an object applying a deforming pressure better than conventional rubber materials, and may have a durometer hardness lower than conventional rubber materials. For example, the elastomeric material may have a hardness on the Shore A scale of less than about 50, from about 0.1 to about 50, or less than about 5.

The elastomeric material may be generally nonsticky, such that the elastomeric cushioning element 140 may return to its original shape after a load is removed. That is, the elastomeric material may be sufficiently nonsticky so that buckling walls 142 do not stick to one another or do not remain stuck to one another after a deforming force is removed. In some embodiments, the buckling walls 142 may include a coating to make the surfaces of the elastomeric material nonsticky. Thus, any contact between adjacent buckling walls 142 may cease immediately or soon after the force is removed. The elastomeric material may be formulated to have any selected stickiness or tackiness, such as to control the rate of response to removal of a load.

Application of a force on the buckling walls 142 (e.g., weight of the cushioned object) causes a compression force on the buckling walls 142. When the applied force to a particular buckling wall 142 exceeds a certain threshold value, that buckling wall 142 buckles, reducing the amount of force carried by that particular buckling wall 142 in comparison to the load it would have carried had it been constrained against buckling (e.g., resulting in a reduced slope of an associated stress-strain curve or load-deflection curve after buckling). The force on nearby buckling walls 142 may increase or change direction due to lateral transfer of the load through the buckling walls 142.

The buckling of the buckling walls 142 may relieve pressure in the location of the buckling by decreasing the amount of the load carried by the buckled buckling walls 142 in comparison to the load they would have carried had they been constrained against buckling. Thus, a load may be transferred to other portions of the elastomeric cushioning element 140. Transfer of all or a portion of the load to other portions of the elastomeric cushioning element 140 may reduce peak pressure, which may increase comfort for humans or animals, and may protect cushioned objects from damage. Such a load transfer may be particularly beneficial when an irregularly shaped object is placed against the buckling walls 142.

Figure 5:
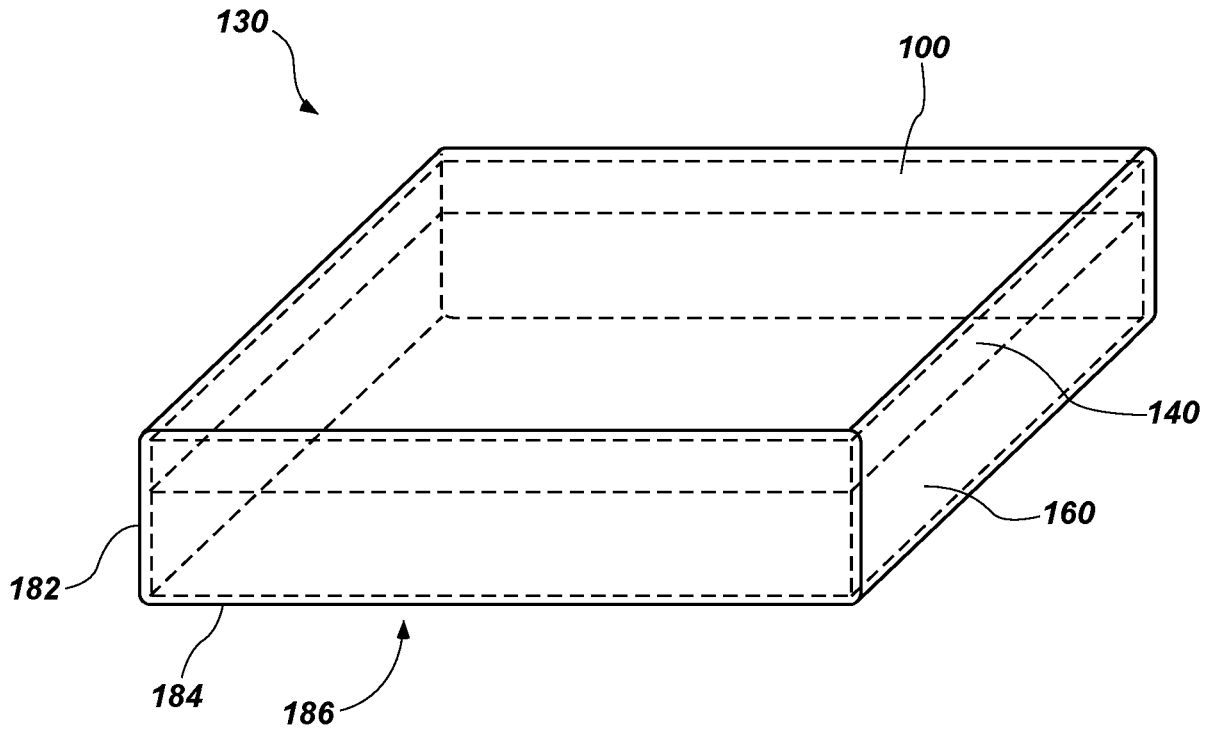
FIG. 5 is a simplified drawing showing the mattress or mattress topper of FIG. 3.

FIG. 5 is a simplified drawing showing the mattress 130, a portion of which is shown in FIG. 3. The fabric 100 may partially or entirely surround the elastomeric cushioning element 140 and the foam base 160. For example, the fabric 100 may be a single unitary stretchable material that covers five sides (e.g., top plus each of four lateral sides) or all six sides of the elastomeric cushioning element 140 and the foam base 160. In some embodiments, there may be no sewn seam between the portion of the fabric 100 covering the top of the elastomeric cushioning element 140 and the portions of the fabric 100 covering the sides of the elastomeric cushioning element 140 and the foam base 160. The fabric 100 may be sewn together in seams 182 only at the lateral corners of the mattress 130. Limiting the length of the seams 182 may allow the fabric 100 to retain its stretchability. The fabric 100 may be secured to a bottom material 186 covering the bottom of the foam base 160 by a zipper 184. The bottom material 186 may be a stretchable or non-stretchable material. In some embodiments, the bottom material 186 may be a portion of the fabric 100 continuous with a portion over one of the lateral sides of the mattress 130. In such embodiments, the zipper 184 may connect the remaining three portions of the fabric 100 over the lateral sides of the mattress 130 to the bottom material 186.

The mattress 130 may provide a combination of improved shock absorption and lower, more uniform pressure supporting cushioned objects in comparison with conventional mattresses. This combination may be beneficial in a variety of applications, such as in the protection of fragile devices (e.g., in shipping) or in human comfort (e.g., seat cushions, shoe inserts, etc.). Reduction of peak pressure may help humans or animals to avoid decubitus ulcers (also known as bed sores or pressure sores).

When a person or animal is resting on the mattress 130, the fabric 100 may compress instead of or in addition to the compression of the elastomeric cushioning element 140 or the foam base 160, such that the person is less aware of the presence of the buckling walls 142 of the elastomeric cushioning element 140. That is, the person may not feel any particular buckling wall 142 or when the buckling walls 142 buckle. Alternatively, the buckling walls 142 or their buckling action may be felt by a user, but the feeling may be muted or diminished by the fabric 100. Thus, the fabric 100 may make a mattress 130 including an elastomeric cushioning element 140 with buckling walls 142 more comfortable to a user than the elastomeric cushioning element 140 would be without the fabric 100 (e.g., with a conventional cover).

Furthermore, the construction of the fabric 100 as a single unitary sheet (i.e., as a single layer of material) may reduce production costs and retain stretchiness in comparison with a quilted material.

Additional non limiting example embodiments of the disclosure are described below.

Embodiment 1

A mattress or mattress topper comprising a cushioning element comprising an elastomeric material forming a plurality of intersecting buckling walls defining a plurality of hollow columns, wherein the elastomeric material comprises an elastomeric polymer and a plasticizer; and a knitted fabric disposed over the cushioning element and configured to move independently of the buckling walls of the cushioning element. The knitted fabric comprises a first layer of stretchable material, a second layer of stretchable material, and a layer of stretchable fill material between the first layer of stretchable material and the second layer of stretchable material. The first layer of stretchable material is knitted together with the second layer of stretchable material as a unitary sheet of fabric including the layer of stretchable fill material.

Embodiment 2

The mattress or mattress topper of Embodiment 1, wherein the knitted fabric comprises a material having a weight per unit area of at least about 250 g/m$^2$.

Embodiment 3

The mattress or mattress topper of Embodiment 2, wherein the knitted fabric comprises a material having a weight per unit area of at least about 400 g/m$^2$.

Embodiment 4

The mattress or mattress topper of Embodiment 3, wherein the knitted fabric comprises a material having a weight per unit area of at least about 650 g/m$^2$.

Embodiment 5

The mattress or mattress topper of any of Embodiments 1 through 4, wherein the knitted fabric comprises a material having a bulk thickness of at least about 2.5 mm.

Embodiment 6

The mattress or mattress topper of Embodiment 5, wherein the knitted fabric comprises a material having a bulk thickness of at least about 5.0 mm.

Embodiment 7

The mattress or mattress topper of Embodiment 6, wherein the knitted fabric comprises a material having a bulk thickness of at least about 25 mm.

Embodiment 8

The mattress or mattress topper of any of Embodiments 1 through 7, wherein the fabric exhibits stretchiness in at least two directions perpendicular to one another.

Embodiment 9

The mattress or mattress topper of any of Embodiments 1 through 8, wherein the knitted fabric consists essentially of materials exhibiting stretchiness in at least two directions perpendicular to one another.

Embodiment 10

The mattress or mattress topper of any of Embodiments 1 through 9, wherein the knitted fabric comprises at least about 3% elastomeric fiber by weight.

Embodiment 11

The mattress or mattress topper of Embodiment 10, wherein the knitted fabric comprises from about 6% to about 20% elastomeric fiber by weight.

Embodiment 12

The mattress or mattress topper of any of Embodiments 1 through 11, wherein the knitted fabric comprises a top layer, a bottom layer, and a fill material between the top layer and the bottom layer.

Embodiment 13

The mattress or mattress topper of Embodiment 12, wherein the top layer, the bottom layer, and the fill material are knitted together to form a unitary sheet of fabric.

Embodiment 14

The mattress or mattress topper of any of Embodiments 1 through 13, wherein the knitted fabric is in direct contact with the cushioning element.

Embodiment 15

The mattress or mattress topper of any of Embodiments 1 through 14, wherein the knitted fabric is not bonded to the buckling walls.

Embodiment 16

The mattress or mattress topper of any of Embodiments 1 through 15, further comprising a flame-retardant fabric between the knitted fabric and the cushioning element.

Embodiment 17

The mattress or mattress topper of any of Embodiments 1 through 16, wherein the knitted fabric is integrated into a removable cover surrounding the cushioning element.

Embodiment 18

The mattress or mattress topper of Embodiment 17, wherein the removable cover comprises a zipper.

Embodiment 19

The mattress or mattress topper of any of Embodiments 1 through 18, wherein the elastomeric material comprises elastomeric gel.

Embodiment 20

The mattress or mattress topper of any of Embodiments 1 through 19, wherein a ratio of a weight of the plasticizer to a weight of the elastomeric polymer is from about 0.1 to about 50.

Embodiment 21

The mattress or mattress topper of Embodiment 20, wherein the ratio of the weight of the plasticizer to the weight of the elastomeric polymer is from about 1.5 to about 10.

Embodiment 22

The mattress or mattress topper of any of Embodiments 1 through 21, wherein the elastomeric material further comprises a plurality of microspheres.

Embodiment 23

The mattress or mattress topper of Embodiment 22, wherein the plurality of microspheres comprises a plurality of hollow microspheres.

Embodiment 24

The mattress or mattress topper of any of Embodiments 1 through 23, wherein the elastomeric polymer comprises an A-B-A triblock copolymer.

Embodiment 25

A method of forming a mattress or mattress topper comprising disposing a knitted fabric over a cushioning element comprising intersecting buckling walls and configuring the knitted fabric to move independently of the buckling walls of the cushioning element. The knitted fabric comprises a first layer of stretchable material, a second layer of stretchable material, and a layer of stretchable fill material between the first layer of stretchable material and the second layer of stretchable material. The first layer of stretchable material is knitted together with the second layer of stretchable material as a unitary sheet of fabric including the layer of stretchable fill material. The cushioning element comprises an elastomeric material forming the intersecting buckling walls, and the buckling walls define a plurality of hollow columns The elastomeric material comprises an elastomeric polymer and a plasticizer.

Embodiment 26

The method of Embodiment 25, further comprising knitting together the first layer and the second layer to encapsulate the fill material between the top layer and the bottom layer of the knitted fabric.

Embodiment 27

The method of Embodiment 25 or Embodiment 26, wherein disposing a knitted fabric over the cushioning element comprises selecting the knitted fabric to comprise a material exhibiting stretchiness in at least two directions perpendicular to one another.

Embodiment 28

The method of any of Embodiments 25 through 27, wherein disposing a knitted fabric over the cushioning element comprises positioning the knitted fabric to entirely cover a top surface of the cushioning element and to at least partially cover a side surface of the cushioning element. The side surface is perpendicular to the top surface when the cushioning element is in an undeformed condition.

While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the disclosure as hereinafter claimed, including legal equivalents thereof. In addition, features from one embodiment may be combined with features of another embodiment while still being encompassed within the scope of the disclosure as contemplated. Further, embodiments of the disclosure have utility with different and various cushion and mattress or mattress topper types and configurations.

What is claimed is:

1. A mattress or mattress topper, comprising:

a cushioning element comprising an elastomeric material forming a plurality of intersecting buckling walls defining a plurality of hollow columns, wherein the elastomeric material comprises an elastomeric polymer and a plasticizer; and a knitted fabric fitted to and secured in place over the cushioning element while being freely laterally movable with respect to adjacent surfaces of the cushioning element, the knitted fabric comprising:

a first layer of stretchable material;

a second layer of stretchable material; and a stretchable fill material between the first layer of stretchable material and the second layer of stretchable material;

wherein the first layer of stretchable material and the second layer of stretchable material are knitted together at laterally spaced apart locations to provide a unitary fabric, with attached locations of the unitary fabric being located at the laterally spaced apart locations and detached locations of the unitary fabric being located between adjacent attached locations, knitting of the attached locations encapsulating the stretchable fill material in the detached locations, each attached location comprising a location where a first thread of the first layer extends to the second layer to form at least a portion of the second layer and where a second thread of the second layer extends to the first layer to form at least a portion of the first layer, each detached location comprising a location where the stretchable fill material spaces the first layer and the second layer apart from each other.

2. The mattress or mattress topper of claim 1, wherein the knitted fabric comprises a material having a weight per unit area of at least about 250 $g/m^2$.

3. The mattress or mattress topper of claim 2, wherein the knitted fabric comprises a material having a weight per unit area of at least about 400 $g/m^2$.

4. The mattress or mattress topper of claim 1, wherein the knitted fabric comprises a material having a bulk thickness of at least about 2.5 mm.

5. The mattress or mattress topper of claim 4, wherein the knitted fabric comprises a material having a bulk thickness of at least about 5.0 mm.

6. The mattress or mattress topper of claim 1, wherein the knitted fabric exhibits stretchiness in at least two directions perpendicular to one another.

7. The mattress or mattress topper of claim 1, wherein the knitted fabric consists essentially of materials exhibiting stretchiness in at least two directions perpendicular to one another.

8. The mattress or mattress topper of claim 1, wherein the knitted fabric comprises at least about 3% elastomeric fiber by weight.

9. The mattress or mattress topper of claim 1, wherein the knitted fabric is in direct contact with the cushioning element.

10. The mattress or mattress topper of claim 1, further comprising a flame-retardant fabric between the knitted fabric and the cushioning element.

11. The mattress or mattress topper of claim 1, wherein the knitted fabric is integrated into a removable cover removable from the cushioning element.

12. The mattress or mattress topper of claim 1, wherein the elastomeric material comprises elastomeric gel.

13. The mattress or mattress topper of claim 1, wherein a ratio of a weight of the plasticizer to a weight of the elastomeric polymer is from about 0.1 to about 50.

14. The mattress or mattress topper of claim 1, wherein the elastomeric polymer comprises an A-B-A triblock copolymer.

15. A method of forming a mattress or mattress topper, comprising:

knitting a fabric to form a first stretchable layer and a second stretchable layer, with a fill material between the first stretchable layer and the second stretchable layer, the first stretchable layer, the second stretchable layer, and the fill material defining a unitary fabric including attached locations where the first layer of stretchable material and the second layer of stretchable material are knitted together and detached locations between adjacent thinner sections, knitting of the attached locations encapsulating the layer of stretchable fill material in the detached locations, each attached location comprising a location where a first thread of the first stretchable layer extends to the second stretchable layer to form at least a portion of the second stretchable layer and where a second thread of the second stretchable layer extends to the first stretchable layer to form at least a portion of the first stretchable layer, each detached location comprising a location where the first stretchable layer and the second stretchable layer are spaced apart from one another;

defining a fitted cover for a cushioning element comprising an elastomeric material forming intersecting buckling walls that define a plurality of hollow columns, the elastomeric material comprising an elastomeric polymer and a plasticizer from the fabric; and securing the fitted cover in place over the cushioning element in a manner that enables the cover to freely move laterally with respect to surfaces of the cushioning element.

16. The method of claim 15, wherein securing the fitted cover in place over the cushioning element comprises securing the fitted cover in place with the fabric comprising a material exhibiting stretchiness in at least two directions perpendicular to one another.

17. The method of claim 15, wherein securing the fitted cover in place over the cushioning element comprises positioning the fitted cover such that the fabric entirely covers a top surface of the cushioning element and at least partially covers a side surface of the cushioning element.

18. The mattress or mattress topper of claim 1, wherein the knitted fabric stretches in at least two perpendicular directions in a plane of a surface of the knitted fabric.

19. The mattress or mattress topper of claim 18, wherein the knitted fabric stretches in a third direction perpendicular to the plane of the surface of the knitted fabric.

20. The method of claim 16, wherein securing the fitted cover in place comprises securing the fitted cover in place with the fabric comprising a material exhibiting stretchiness in a third direction perpendicular to the plane of the surface of the knitted fabric.

21. A mattress or mattress topper, comprising:

a cushioning element comprising an elastomeric material forming a plurality of intersecting buckling walls defining a plurality of hollow columns; and a fitted cover encasing the cushioning element while being freely laterally movable with respect to surfaces of the cushioning element, the fitted cover comprising a knitted fabric comprising:

a first stretchable layer;

a second stretchable layer superimposed with the first stretchable layer, the first stretchable layer and the second stretchable layer including:

attached locations where the first stretchable layer and the second stretchable layer are integrally knit together to provide a unitary fabric, the attached locations comprising thinner sections of the unitary fabric, each thinner section including a first thread of the first stretchable layer extending to the second stretchable layer to form at least a portion of the second stretchable layer and a second thread of the second stretchable layer extending to the first stretchable layer to form at least a portion of the first stretchable layer; and detached locations between laterally adjacent attached locations, where the first stretchable layer and the second stretchable layer can be spaced apart from each other, and comprising thicker sections of the unitary fabric; and a fill material between the first stretchable layer and the second stretchable layer in the detached locations and spacing the first stretchable layer apart from the second stretchable layer at the detached locations.

22. The mattress or mattress topper of claim 21, wherein the knitted fabric exhibits stretchiness in at least two directions perpendicular to one another.

23. The mattress or mattress topper of claim 21, wherein the fitted cover includes a top side and four lateral sides comprising the kitted fabric fitted to and positioned respectively over a top surface and four lateral surfaces of the cushioning element.

24. The mattress or mattress topper of claim 21, wherein the fill material is encapsulated by the first stretchable layer and the second stretchable layer.

* * * * *